US007819605B2

(12) United States Patent
Heald

(10) Patent No.: US 7,819,605 B2
(45) **Date of Patent: *Oct. 26, 2010**

(54) DELINEATOR MOUNTING SYSTEM

(76) Inventor: Darrell Heald, 217 Legend Oaks Dr., Georgetown, TX (US) 78628

( * ) Notice: Subject to any disclaimer, the term of this patent is extended or adjusted under 35 U.S.C. 154(b) by 0 days.

This patent is subject to a terminal disclaimer.

(21) Appl. No.: 12/732,112

(22) Filed: Mar. 25, 2010

(65) Prior Publication Data

US 2010/0172693 A1 Jul. 8, 2010

Related U.S. Application Data

(63) Continuation-in-part of application No. 12/016,985, filed on Jan. 18, 2008, now Pat. No. 7,722,286.

(51) Int. Cl.
*E01F 9/013* (2006.01)

(52) U.S. Cl. ..... 404/9; 40/607.1; 40/612; 116/63 R

(58) Field of Classification Search ..... 40/606.01, 40/607.01, 607.1, 612; 404/9; 116/63 R
See application file for complete search history.

(56) References Cited

U.S. PATENT DOCUMENTS

| | | | | |
|---|---|---|---|---|
| 1,726,817 | A | 9/1929 | Franklin | |
| 2,719,214 | A | 9/1955 | Potter | |
| 3,564,984 | A | 2/1971 | Alexander | |
| 4,435,107 | A | 3/1984 | Sweeney | |
| 4,596,489 | A | 6/1986 | Mariol et al. | |
| 4,611,949 | A | 9/1986 | Schmanski | |
| 4,636,109 | A | 1/1987 | Clausen et al. | |
| 4,691,818 | A | 9/1987 | Weber | |
| 4,926,592 | A * | 5/1990 | Nehls | 52/98 |
| 5,040,478 | A | 8/1991 | Hughes | |
| 5,197,819 | A | 3/1993 | Hughes | |
| 5,439,311 | A | 8/1995 | Hughes, Jr. | |
| 6,267,529 | B1 | 7/2001 | Mudryk et al. | |
| 6,318,011 | B1 | 11/2001 | McCudden | |
| 6,324,800 | B1 * | 12/2001 | Valentz et al. | 52/298 |
| 6,422,783 | B1 * | 7/2002 | Jordan | 404/9 |
| D463,250 | S * | 9/2002 | Valentz | D8/349 |
| 6,516,573 | B1 | 2/2003 | Farrell et al. | |
| 6,530,166 | B1 | 3/2003 | Garfinkle et al. | |
| 6,540,196 | B1 | 4/2003 | Ellsworth | |
| 6,619,629 | B1 | 9/2003 | Boswell | |
| 6,692,180 | B2 * | 2/2004 | Wu | 403/292 |
| 6,709,234 | B2 * | 3/2004 | Gilbert et al. | 415/200 |
| 6,868,641 | B2 * | 3/2005 | Conner et al. | 52/98 |
| 7,003,919 | B2 | 2/2006 | Riker | |

(Continued)

FOREIGN PATENT DOCUMENTS

KR 20-0255623 Y1 12/2001

OTHER PUBLICATIONS

"Why is Dura-Curb the Best Choice?", http://duracurb.net/duracurb.php?id=4, prior art status admitted.

(Continued)

*Primary Examiner*—Gary S Hartmann
(74) *Attorney, Agent, or Firm*—Daniel V. Thompson

(57) ABSTRACT

A delineator mounting system has a coupler for mating a delineator having a cylindrical tubular lower end in a curb-like mount having a cavity with square cross-sections.

3 Claims, 5 Drawing Sheets

U.S. PATENT DOCUMENTS

| | | | | |
|---|---|---|---|---|
| 7,077,599 | B1 | 7/2006 | Hughes, Jr. | |
| 7,111,815 | B2 * | 9/2006 | Mettler et al. | 248/519 |
| 7,195,222 | B2 * | 3/2007 | Dent | 248/511 |
| D547,463 | S * | 7/2007 | Gross et al. | D25/133 |
| 7,523,715 | B2 * | 4/2009 | Mettler et al. | 116/63 R |
| 7,553,103 | B2 | 6/2009 | Jameson et al. | |
| 7,621,691 | B2 * | 11/2009 | Hannah | 404/7 |
| 7,681,857 | B2 * | 3/2010 | Mettler et al. | 248/523 |
| 7,722,286 | B2 * | 5/2010 | Heald | 404/9 |
| 2006/0010790 | A1 * | 1/2006 | Perry | 52/98 |

OTHER PUBLICATIONS

"Dura-Curb Raised Separator System Details", http://duracurb.net/duracurb.php?id=6, prior art status admitted.

"Delineators", http://duracurb.net/duracurb.php?id=13, prior art status admitted.

FG300 Curb System Brochure Nov. 2009 low rez.pp. 1,6,7, prior art status admitted.

Tuff Curb brochure.pp. 3,4,6,7, prior art status admitted.

"Qwick Kurb®, Inc- The System A Longitudinal Channelizing Barricade", http://www.qwickkurb.com/system.html, prior art status admitted.

"Qwick Kurb®, Inc-The Uprights", http://www.qwickkurb.com/uprights.html, prior art status admitted.

"Qwick Kurb®, Inc-The Separator", http://www.qwickkurb.com/separator.html, prior art status admitted.

* cited by examiner

DELINEATOR MOUNTING SYSTEM

CROSS REFERENCE TO RELATED APPLICATION

This is a continuation in part of application Ser. No. 12/016,985, filed Jan. 18, 2008, now U.S. Pat. No. 7,722,286.

BACKGROUND OF INVENTION

The present invention relates in general to traffic delineators. More specifically, but without restriction to the particular use which is shown and described, this invention relates to delineators that may be surface mounted on level surfaces and include a substantial curb-like component. The present invention also relates to cylindrical tubular delineators that may be mounted in square holes by way of a specialized coupler.

A traffic delineator is a conventional device used upon many highways to indicate to the driver the edge of the road or, in the alternative, an upcoming division or revision in traffic lanes. In a design of such marking posts or traffic delineators it is desirable for the post to be constructed in a manner which is inexpensive and provides for a quick and simple installation. The post should also be able to withstand many impacts from the bumpers of high speed vehicles without sustaining damage or destroying the post and without pulling the post out of or from connection with the ground/pavement.

The ease and speed of installation is particularly important in view of the large number of parking posts or traffic delineators which are used along the highways and expressways and, in fact, frequently the installation of the posts is performed when the installer is exposed to motor vehicle traffic. For these reasons, it is also desirable for the post to be designed for quick and conventional replacement in the event it is destroyed or no longer usable. Further, the post must be installed in a manner by which the post may not be easily damaged or removed by persons walking along the roadway and/or during the installation process.

One particularly successful delineator mounting system is that shown in U.S. Pat. No. 7,553,103, issued Jun. 20, 2009, where the delineator is mounted on a pivotable T-shaped tubular structure. That system is best used with widely-spaced delineators. That system would not be adapted for use where a curb-like function is desired, or the simplicity of a square to round delineator coupler is desired.

SUMMARY OF THE INVENTION

A delineator mounting system has a coupler for mating a delineator having a cylindrical tubular lower end in a curb-like mount having a cavity with square cross-sections.

BRIEF DESCRIPTION OF DRAWINGS

A more complete understanding of the invention and its advantages will be apparent from the Detailed Description taken in conjunction with the accompanying Drawings, in which.

DETAILED DESCRIPTION

The disclosures of U.S. Pat. No. 7,553,103 and U.S. Patent Application Publication No. 20090183452 are hereby incorporated by reference.

Figure 1:
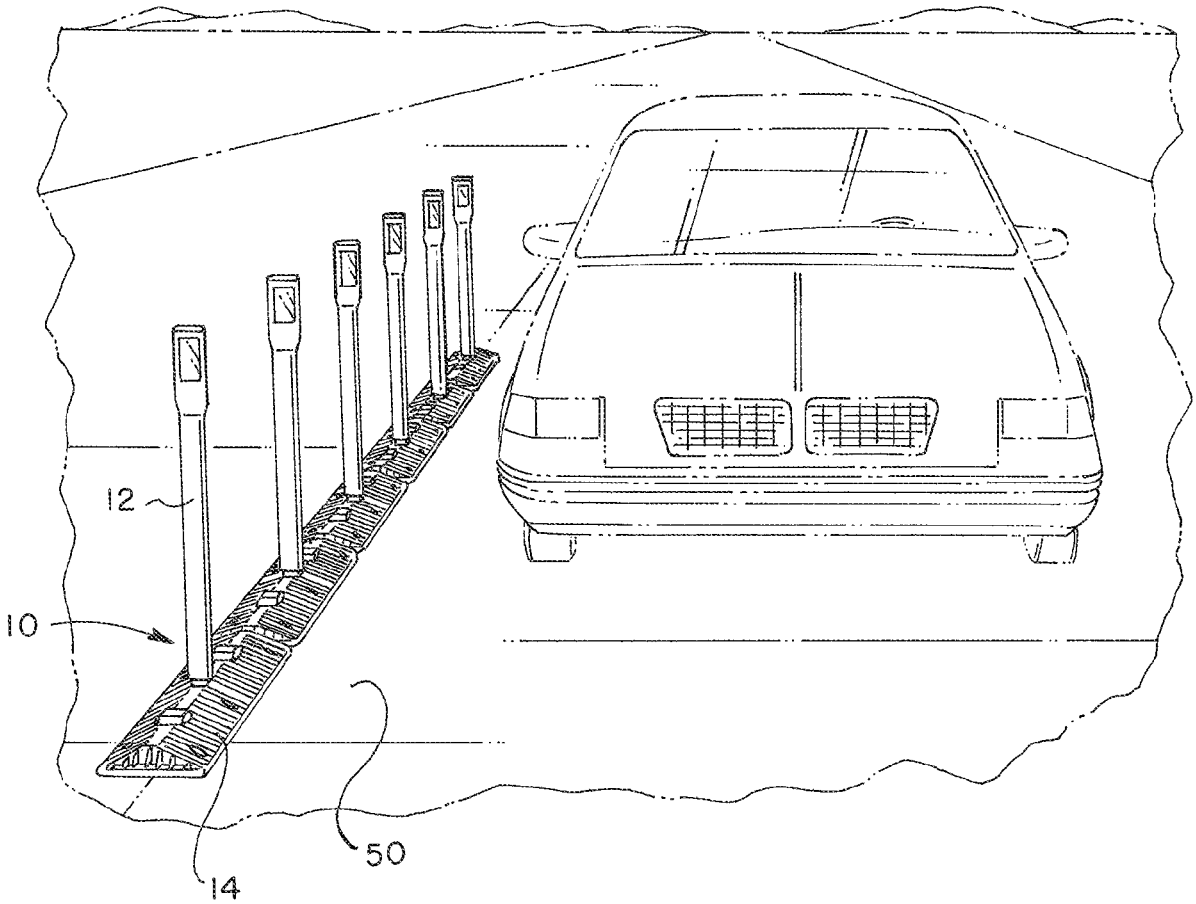
FIG. 1 is a top perspective view of a row of curb-like delineator mounts and delineators used in the mounting system of the present invention.
Figure 2:
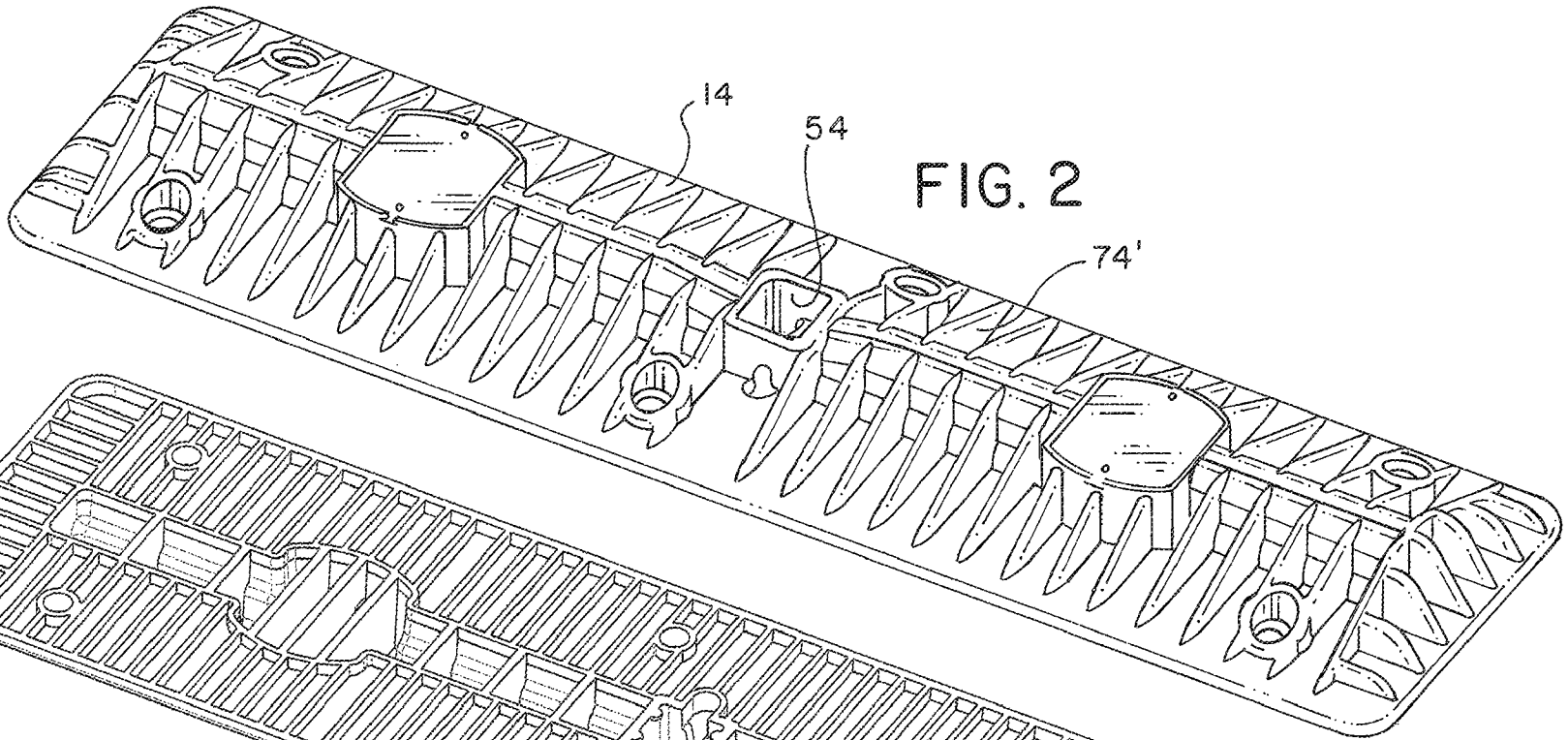
FIG. 2 is a top perspective view of the curb-like delineator mount used in the mounting system of the present invention.
Figure 3:
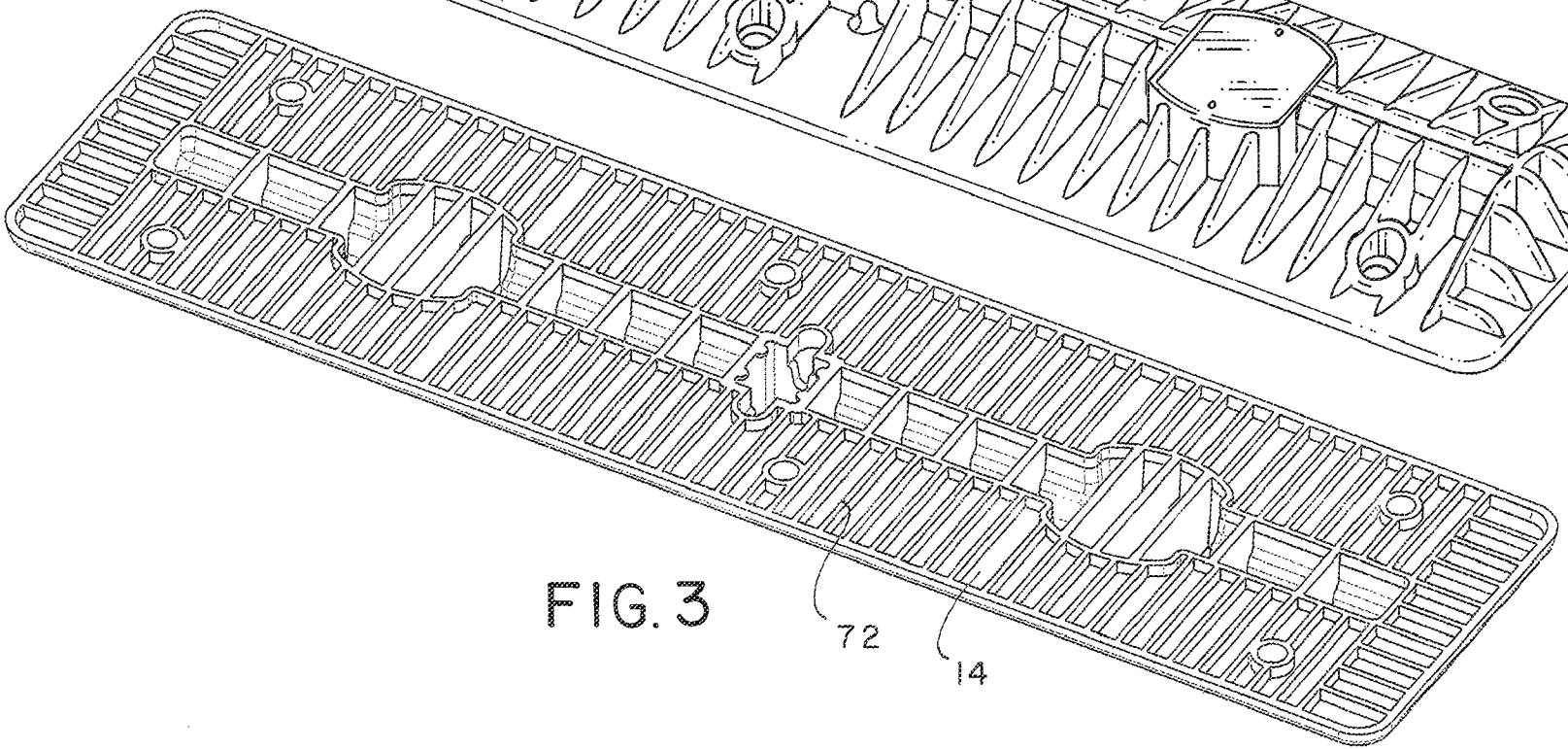
FIG. 3 is a bottom perspective view of the mount of FIG. 2.
Figure 4:
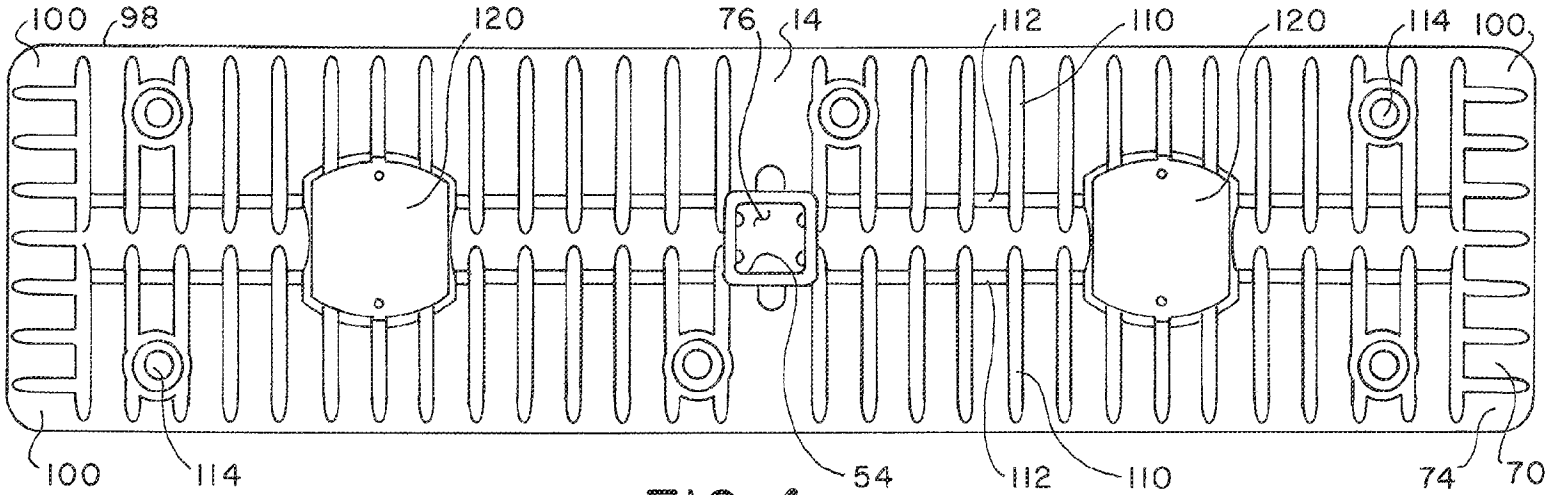
FIG. 4 is a bottom view of the mount of FIG. 2.
Figure 5:
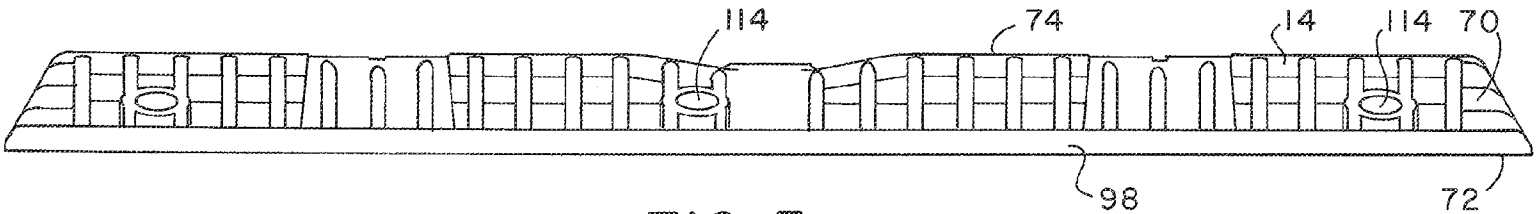
FIG. 5 is a side view of the mount of FIG. 2.
Figure 6:
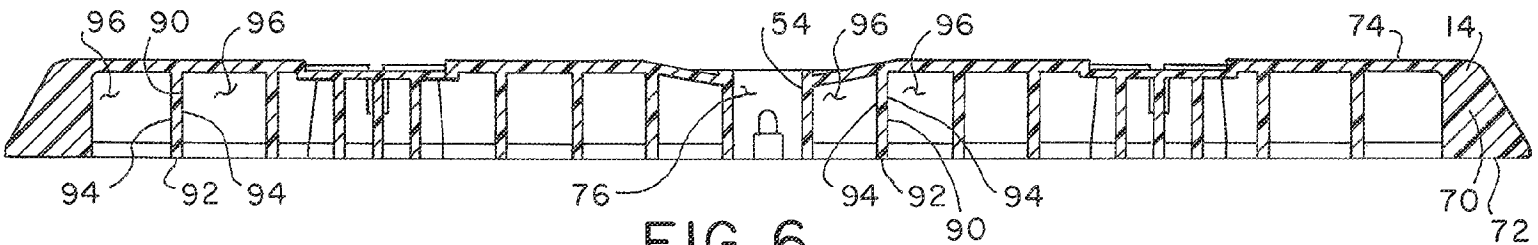
FIG. 6 is a partially broken-away side view of the mount of FIG. 2.
Figure 7:
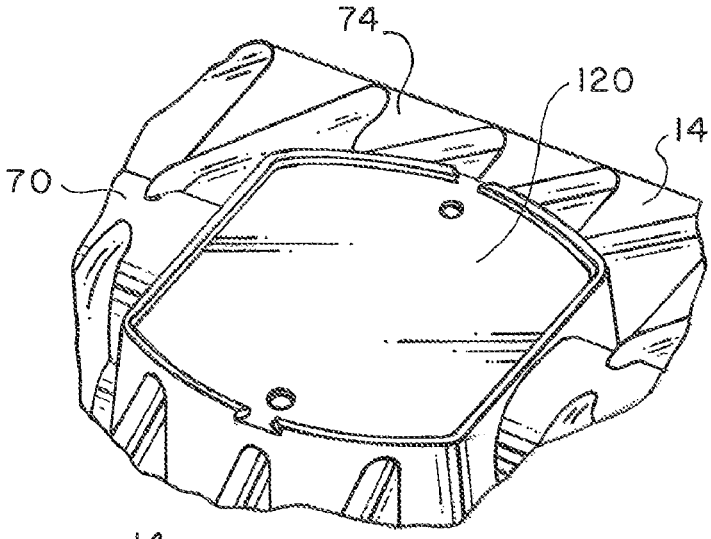
FIG. 7 is an enlarged perspective view of a recessed pad in the top of the mount for attachment of a reflective marker.
Figure 8:
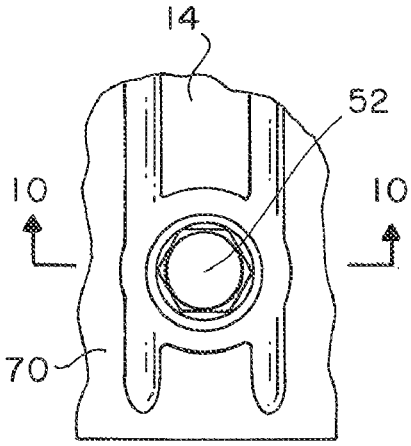
FIG. 8 is an enlarged top view of a fastener aperture and fastener in the mount.
Figure 9:
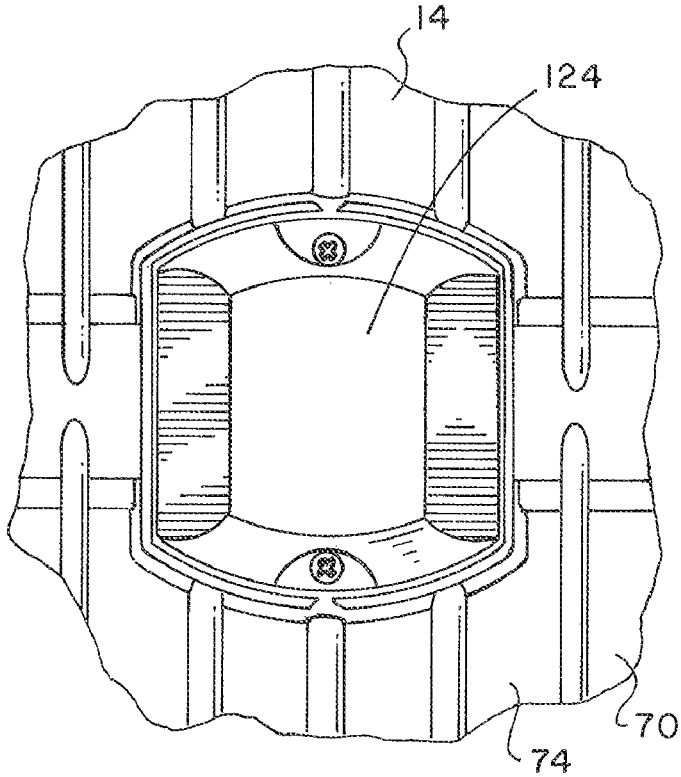
FIG. 9 is an enlarged top view of a reflective marker attached to the recessed pad of FIG. 7.
Figure 10:
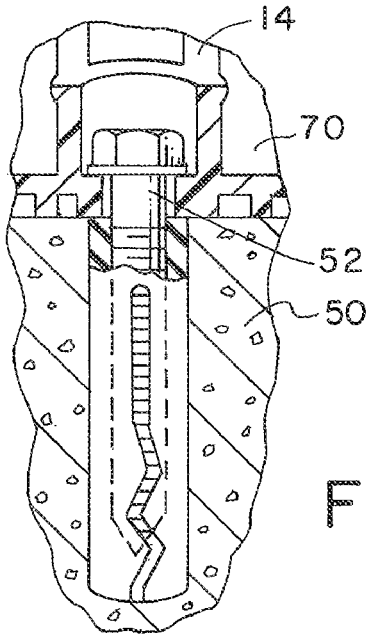
FIG. 10 is a sectional view taken along lines 10-10 of FIG. 8.
Figure 11:
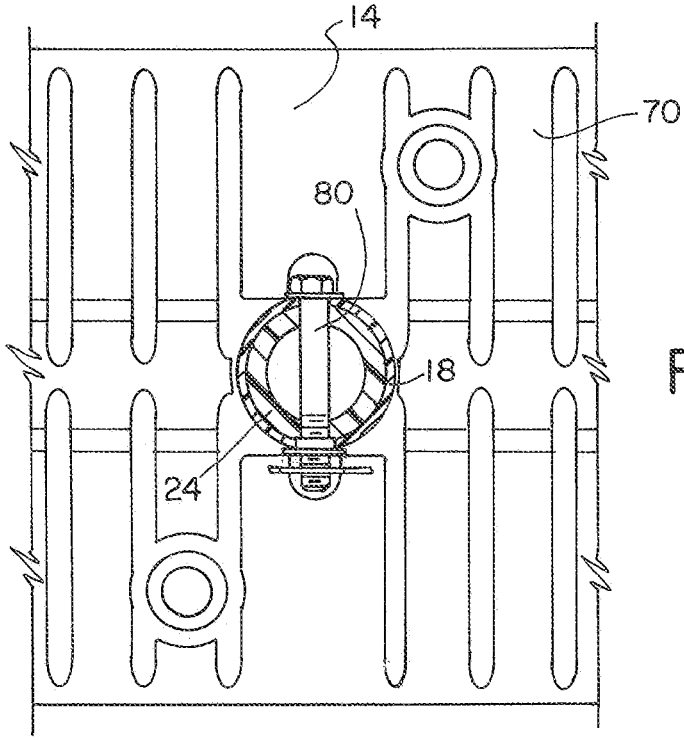
FIG. 11 is a sectional view taken along lines 11-11 of FIG. 13.
Figure 12:
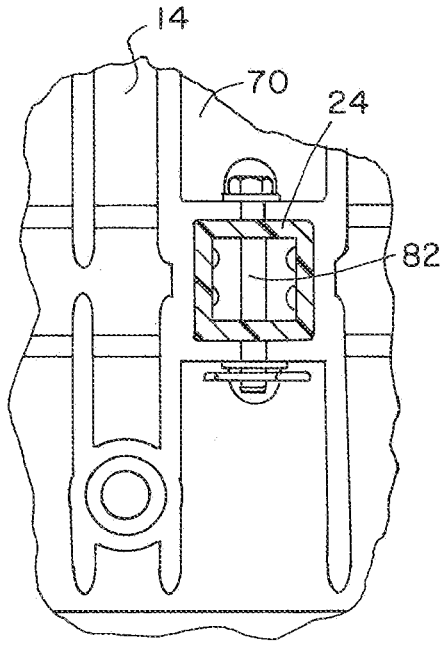
FIG. 12 is a sectional view taken along lines 12-12 of FIG. 13.

Referring to FIGS. 1-13, where like numerals refer to like and corresponding parts, a delineator mounting system 10 includes a delineator 12 and a curb-like mount 14. As shown in FIG. 1, a series of identical mounts 14 can be arranged end to end in a straight line to form a continuous curb, where the length of mounts 14 establishes the spacing of delineators 12. Slightly curved lines of mounts 14 can also be formed.

Figure 13:
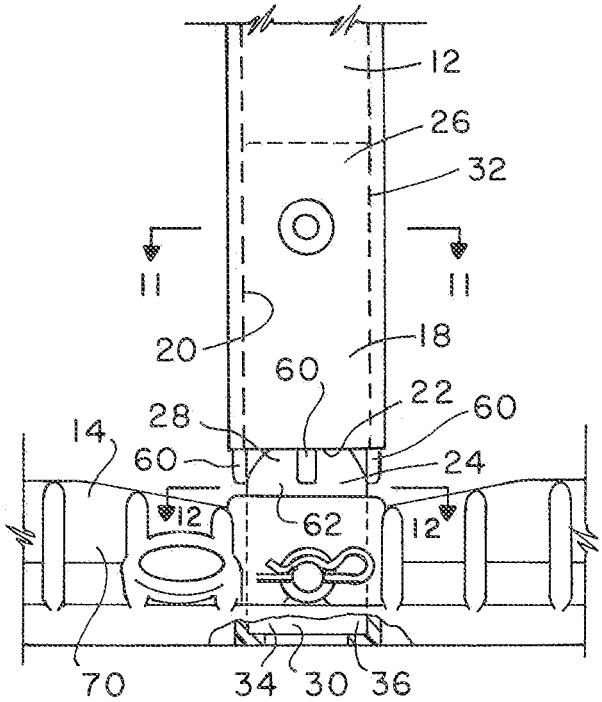
FIG. 13 is a partially broken-away enlarged side view of the delineator mounting portion of the system.

Each delineator 12 has a lower end 18 having a cylindrical inner surface 20 and a lower edge 22 (FIG. 13). A coupler 24 has an upper end 26, a transition portion 28, and a lower end 30. The coupler upper end 26 has a cylindrical outer surface 32 sized to closely interfit within the delineator lower end inner surface 20. The coupler lower end 34 has a square cross-section outer surface 36. The coupler transition portion 28 is located in a medial location of the coupler 24 between the upper and lower ends 26,30.

The mount 14 is adapted to be mounted to a pavement surface 50 by way of fasteners 52. Alternatively, adhesive may be used in lieu of, or in addition to, the fasteners 52.

The mount 14 has a centrally-located, square cross-section, inner surface 54 sized to closely interfit about the coupler lower end outer surface 36. The delineator lower end 18 is interfitted with the coupler upper end 26, and the coupler lower end 34 is interfitted with the square cross-section inner surface 54 of the mount 14.

The coupler transition portion 28 includes a plurality of abutment projections 60 extending from an outer surface 62 thereof. The abutment projections 60 contact the lower edge 22 of the delineator 12.

The mount 14 includes a base 70 having a generally-planar bottom surface 72, a top surface 74, and a cavity 76 in the base located between the top and bottom surfaces 72,74 with walls in the cavity 76 forming the square cross-section inner surface 54.

An upper fastener 80 extends through the coupler upper end 26 and delineator lower end 18, and a lower fastener 82 extends through the coupler lower end 34 and the walls in the cavity 76.

The base bottom surface 72 is partially defined by adhesive retention ribs 90 having planar bottoms 92 and spaced sides 94 to form adhesive retention cavities 96. The base 70 has a continuous side wall 98 defining a generally-rectangular shape with rounded corners 100.

The base 70 has a generally-pyramidal top surface 74 defined by buttress ribs 110 extending from the side wall 98 to central longitudinal ribs 112. The base 70 has walls defining a plurality of fastener through-holes 114 extending through the base 70 from the top surface 74 to the bottom surface 72.

Recessed pads 120 are provided in the top surface 74 for attachment of reflective markers 122.

The base 70 will typically be molded from a strong and rigid polyethylene. In contrast, it may be desirable to mold coupler 24 from of a flexible polyurethane thermoplastic elastomer, such that a delineator 12 will deflect and return to position when struck by a vehicle.

In operation, the delineator mounting system 10 uses the square to round coupler 24 which allows for multiple hits without a failure. Couplers 24 with fasteners 80 and 82 also allow for a quick delineator change out, minimizing the worker's exposure to traffic. The bottom of the base is designed to allow the installer to bolt it down or epoxy it to the surface, as conditions dictate. The ribbed design on the top of curb allows for less surface area for tires to touch and possible crush or break mounts. The top of the base curb has 2 recessed pads to attach raised pavement reflective markers to better delineate the curb-like structure at night. The base has a ramped up area on both ends to minimize the bump a car feels when hitting them. Also with the ramped up area a separate nose piece is not required, unlike some prior designs which have to supply nose and end pieces with each run of curb.

It will be understood that each of the elements described above, or two or more together, may also find a useful application in other types of constructions differing from the type described above.

While the invention has been illustrated and described as embodied in a particular delineator mounting system, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A delineator mounting system, comprising;

a delineator with a lower end having a cylindrical inner surface and a lower edge;

a coupler having an upper end, a transition portion, and a lower end;

the coupler upper end having a cylindrical outer surface sized to closely interfit within the delineator lower end inner surface;

the coupler lower end having a square cross-section outer surface;

the coupler transition portion in a medial location of the coupler between the upper and lower ends;

a mount adapted to be mounted to a pavement surface, the mount having a square cross-section inner surface sized to closely interfit about the coupler lower end outer surface;

the delineator lower end interfitted with the coupler upper end, the coupler lower end interfitted with the square cross-section inner surface of the mount; and with the coupler transition portion including a plurality of abutment projections extending from an outer surface thereof.

2. The delineator mounting system of claim 1 with the abutment projections contacting the lower edge of the delineator.

3. A delineator mounting system, comprising;

a delineator with a lower end having a cylindrical inner surface and a lower edge;

a coupler having an upper end, a transition portion, and a lower end;

the coupler upper end having a cylindrical outer surface sized to closely interfit within the delineator lower end inner surface;

the coupler lower end having a square cross-section outer surface;

the coupler transition portion in a medial location of the coupler between the upper and lower ends;

a mount adapted to be mounted to a pavement surface, the mount having a square cross-section inner surface sized to closely interfit about the coupler lower end outer surface;

the delineator lower end interfitted with the coupler upper end, the coupler lower end interfitted with the square cross-section inner surface of the mount;

with the coupler transition portion including a plurality of abutment projections extending from an outer surface thereof;

with the abutment projections contacting the lower edge of the delineator;

with the mount including a base having a generally-planar bottom surface, a top surface, and a cavity in the base located between the top and bottom surfaces, with walls in the cavity forming the square cross-section inner surface;

with an upper fastener extending through the coupler upper end and delineator lower end, and a lower fastener extending through the coupler lower end and the walls in the cavity; and the base bottom surface partially defined by adhesive retention ribs having planar bottoms and spaced sides to form adhesive retention cavities, the base having a continuous side wall defining a generally-rectangular shape with rounded corners, the base having a generally-pyramidal top surface defined by buttress ribs extending from the side wall to central longitudinal ribs, and the base having walls defining a plurality of fastener through-holes extending through the base from the top surface to the bottom surface.

* * * * *